US010773259B2

(12) United States Patent
Niklewski et al.

(10) Patent No.: US 10,773,259 B2
(45) Date of Patent: Sep. 15, 2020

(54) ECCENTRIC ASSEMBLY FOR GYRATORY OR CONE CRUSHER

(71) Applicant: Metso Minerals Industries, Inc., Waukesha, WI (US)

(72) Inventors: Andrzej Niklewski, Sao Paulo (BR); Paulo Barscevicius, Sao Paulo (BR)

(73) Assignee: Metso Minerals Industries, Inc., Waukesha, WI (US)

( * ) Notice: Subject to any disclaimer, the term of this patent is extended or adjusted under 35 U.S.C. 154(b) by 320 days.

(21) Appl. No.: 15/753,391

(22) PCT Filed: Aug. 19, 2016

(86) PCT No.: PCT/IB2016/054964
§ 371 (c)(1),
(2) Date: Feb. 19, 2018

(87) PCT Pub. No.: WO2017/033103
PCT Pub. Date: Mar. 2, 2017

(65) Prior Publication Data

US 2018/0236454 A1 Aug. 23, 2018

(30) Foreign Application Priority Data

Aug. 21, 2015 (EP) ..... 15182030

(51) Int. Cl.
*B02C 2/04* (2006.01)

(52) U.S. Cl.
CPC ..... *B02C 2/04* (2013.01); *B02C 2/042* (2013.01)

(58) Field of Classification Search
CPC .. B02C 2/02; B02C 2/04; B02C 2/042; B02C 2/045; B02C 2/047; B02C 2/06; B02C 2/08
See application file for complete search history.

(56) References Cited

U.S. PATENT DOCUMENTS 3,908,916 A * 9/1975 Klushantsev ..... B02C 2/06 241/213
4,589,600 A 5/1986 Schuman
(Continued)

FOREIGN PATENT DOCUMENTS

CN 2160465 4/1994
CN 203540603 U 4/2014
(Continued)

OTHER PUBLICATIONS

Decision to Grant issued in Russian Patent Application No. 2018109497 dated Dec. 2018.
(Continued)

*Primary Examiner* — Shelley M Self
*Assistant Examiner* — Fred C Hammers
(74) *Attorney, Agent, or Firm* — Andrus Intellectual Property Law, LLP

(57) ABSTRACT

An eccentric assembly for use in a gyratory or cone crusher is provided. The gyratory or cone crusher includes a main shaft having a longitudinal extension along a central axis of the crusher, a head assembly including a crushing head provided with a first crushing shell, and a frame provided with a second crushing shell, wherein the first and second crushing shells between them define a crushing gap. The eccentric assembly is provided with an inner circumferential surface and an outer circumferential surface eccentrically arranged relative to the inner circumferential surface, wherein the inner circumferential surface of the eccentric assembly is arranged for being journalled to the main shaft so that the eccentric assembly is adapted to rotate about said central axis, and wherein the outer circumferential surface of the eccentric assembly is arranged for being journalled to the crushing head. The eccentric assembly includes a first eccentric part and a second eccentric part which is configured for
(Continued)

being located at a distance from the first eccentric part in a direction along the central axis.

13 Claims, 3 Drawing Sheets

(56) References Cited

U.S. PATENT DOCUMENTS

| | | | | |
|---|---|---|---|---|
| 6,000,648 | A * | 12/1999 | Ambrose | B02C 2/04 241/215 |
| 6,036,129 | A | 3/2000 | Ambrose | |
| 2012/0223171 | A1 | 9/2012 | Flath et al. | |

FOREIGN PATENT DOCUMENTS

| | | | |
|---|---|---|---|
| CN | 104507580 | A | 4/2015 |
| CN | 204380753 | U | 6/2015 |
| GB | 819329 | A | 9/1959 |
| SU | 1121035 | A1 | 10/1984 |
| SU | 1719055 | A1 | 3/1992 |
| WO | 2014016060 | | 1/2014 |

OTHER PUBLICATIONS

International Search Report and Written Opinion for PCT/IB2016/054964 dated Oct. 27, 2016.
International Preliminary Report and Written Opinion for PCT/IB2016/054964 dated Dec. 7, 2017.
Office Action issued for Co-Pending Chinese Patent Application No. 20190402, dated Mar. 5, 2019.

* cited by examiner

ECCENTRIC ASSEMBLY FOR GYRATORY OR CONE CRUSHER

CROSS-REFERENCE TO RELATED APPLICATIONS

This application is the U.S. national stage application of International Application PCT/IB2016/054964 filed Aug. 19, 2016, which international application was published on Mar. 2, 2017, as International Publication WO 2017/033103 in the English language. The International Application claims priority of European Patent Application 15182030.5, filed Aug. 21, 2015.

FIELD OF THE INVENTION

The present invention relates to an eccentric assembly for use in a gyratory crusher or cone crusher. The invention also relates to a crusher including such an eccentric assembly, and to a counterweight assembly for use in such an eccentric assembly and/or such a gyratory or cone crusher.

Cone crushers and gyratory crushers are two types of rock crushing systems, which generally break apart rock, stone or other material in a crushing gap between a stationary element and a moving element. A cone or gyratory crusher is comprised of a head assembly including a crushing head that gyrates about a vertical axis within a stationary bowl attached to a main frame of the rock crusher. The crushing head is assembled surrounding an eccentric that rotates about a fixed shaft to impart the gyratory motion of the crushing head which crushes rock, stone or other material in a crushing gap between the crushing head and the bowl. The eccentric can be driven by a variety of power drives, such as an attached gear, driven by a pinion and countershaft assembly, and a number of mechanical power sources, such as electrical motors or combustion engines.

The gyratory motion of the crushing head with respect to the stationary bowl crushes rock, stone or other material as it travels through the crushing gap. The crushed material exits the cone crusher through the bottom of the crushing gap.

During operation of a cone or gyratory crusher, the gyratory movement of the head assembly and mantle and the offset rotation of the eccentric create large, unbalanced forces.

PRIOR ART

In an attempt to compensate for the large, unbalanced forces generated during operation of a cone or gyratory crusher, a counterweight assembly has been connected to the eccentric for rotation therewith.

In some of the prior art solutions, the counterweight is, however, far from the center of gravity of the moving parts within the crusher, so that a bending effect remains which affects the main shaft of the crusher.

US 2012/0223171 A1 relates to a counterweight assembly for use in a cone crusher. In general, the counterweight assembly rotates along with an eccentric about a fixed main shaft in the cone crusher. The counterweight assembly provides balance for the offset rotation of the eccentric and the gyratory movement of the head assembly and mantle. The counterweight assembly is mounted for rotation with the eccentric and includes a counterweight body having a generally annular shape. The counterweight body of the counterweight assembly in one embodiment includes both a weighted section and an unweighted section that are joined to each other to define the generally annular shape for the casting. The counterweight ring is arranged so as to surround the eccentric, thereby adding to the radial dimensions of the crusher.

SUMMARY OF THE INVENTION

In view of the above, the present invention provides an eccentric assembly for use in a gyratory or cone crusher as recited in claim 1.

The gyratory or cone crusher, in which the eccentric assembly of the invention is used, comprises a main shaft having a longitudinal extension along a central axis of the crusher, a head assembly including a crushing head provided with a first crushing shell, and a frame provided with a second crushing shell, wherein the first and second crushing shells between them define a crushing gap. The eccentric assembly is provided with an inner circumferential surface and an outer circumferential surface eccentrically arranged relative to the inner circumferential surface, wherein the inner circumferential surface of the eccentric assembly is arranged for being journalled to the main shaft so that the eccentric assembly is adapted to rotate about said central axis, and wherein the outer circumferential surface of the eccentric assembly is arranged for being journalled to the crushing head.

In accordance with the invention, the eccentric assembly includes a first eccentric part and a second eccentric part which is configured for being located at a distance from the first eccentric part in a direction along the central axis.

By providing first and second eccentric parts spaced apart from each other in a direction along the central axis, the arrangement of the eccentric assembly becomes more flexible and can be suitably adjusted so as to obtain an optimum movement of the crushing head in view of a desired crushing pattern.

The eccentric assembly can further be provided with an intermediate element arranged between the first eccentric part and the second eccentric part in a direction along the central axis. This intermediate element has either a non-eccentric shape or at least an eccentricity which is different from the eccentricity of the first and second eccentric parts. The gyratory movement of the head assembly is thereby imposed by the first and second eccentric parts of the eccentric assembly, whereas the intermediate element is disposed between the two eccentric parts.

The intermediate element is preferably is coupled to the first and/or the second eccentric parts so as to rotate together therewith. The intermediate element can either be formed in one piece with the first and/or the second eccentric part, or formed separate from and coupled with the first and/or the second eccentric part.

The intermediate element can be configured as a sleeve-type element surrounding the main shaft, preferably with a gap between the outer circumference of the main shaft and the inner circumference of the sleeve-type intermediate element. The shape of the intermediate element thereby essentially follows the shape of the main shaft. In some embodiments, the intermediate element is therefore essentially cone shaped. The intermediate element may also have at least two sections having different inclinations relative to the central axis, in particular if the main shaft is also configured accordingly.

The eccentric assembly can further be provided with a counterweight assembly including a counterweight body, the counterweight assembly being configured to rotate together with the eccentric assembly and compensate for the unbalanced forces generated by the gyratory movement of the head assembly and the offset rotation of the eccentric parts.

In order to provide for the counterweight assembly to rotate together with the eccentric assembly, the counterweight assembly is preferably coupled with the eccentric assembly.

By locating the counterweight body between the first and the second eccentric parts in the direction along the central axis, it is possible to align the load and counterbalance load, reducing or eliminating the bending effect, without increasing the radial dimensions of the cone or gyratory crusher as a whole.

The counterweight body may have at least in part a cylindrical outer surface, preferably in a lower section of the counterweight body. Alternatively or in addition, the counterweight body may have at least in part a tapered outer surface, preferably in an upper section of the counterweight body. The counterweight body may have at least two sections as seen in the direction along the central axis, the outer circumferential surfaces of which have different inclinations relative to the central axis. In any one of these embodiments, the shape of the counterweight is designed so as to obtain a desired mass distribution and center of gravity of the counterweight assembly.

The circumferential location of the counterweight is suitably chosen so as to compensate for the forces imparted by the eccentric surfaces of the two eccentric parts during rotation of the eccentric: a weighted section of the counterweight can be generally opposite the wide portion of the eccentric while an unweighted section is generally opposite the thin portion of the eccentric.

In embodiments in which the eccentric assembly includes an intermediate element as described above, which has e.g. the form of a sleeve and extends between the first and second eccentric parts, the counterweight body may suitably be coupled with the intermediate element. The counterweight body may be formed in one piece with the intermediate element, or the counterweight body may be formed separate from and coupled with the intermediate element, e.g. by welding. The assembly of the two eccentric parts, the intermediate element extending there between, and the counterweight body attached to the intermediate element are thereby arranged so as to rotate together.

If the counterweight body has at least in part a tapered outer surface, preferably in an upper section of the counterweight body, the taper of the counterweight body may also follow a taper of the intermediate element.

The present invention also provides a gyratory or cone crusher as recited in claim 13.

The gyratory or cone crusher may further comprise a counterweight assembly including a counterweight body, the counterweight assembly being configured so as to compensate for unbalanced forces generated by the gyratory movement of the head assembly and the offset rotation of the eccentric assembly. The counterweight body may be located between the upper and the lower eccentric parts as seen in the direction along the central axis. The counterweight assembly may be configured and arranged so that the center of gravity thereof is arranged essentially at the same vertical height as the center of gravity of the eccentric assembly and head assembly together, and diametrically opposite thereto.

Finally, the present invention provides a counterweight assembly for use in an eccentric assembly and/or in a gyratory or cone crusher according to the invention, the counterweight assembly being configured so as to compensate for unbalanced forces generated by the gyratory movement of the head assembly and the offset rotation of the eccentric assembly of the gyratory or cone crusher.

BRIEF DESCRIPTION OF THE DRAWINGS

The above, as well as additional objects, features and advantages of the present invention will be better understood through the following illustrative and non-limiting detailed description of preferred embodiments of the present invention, with reference to the appended drawing, where the same reference numerals will be used for similar elements, wherein.

DETAILED DESCRIPTION OF PREFERRED EMBODIMENTS

Figure 1:
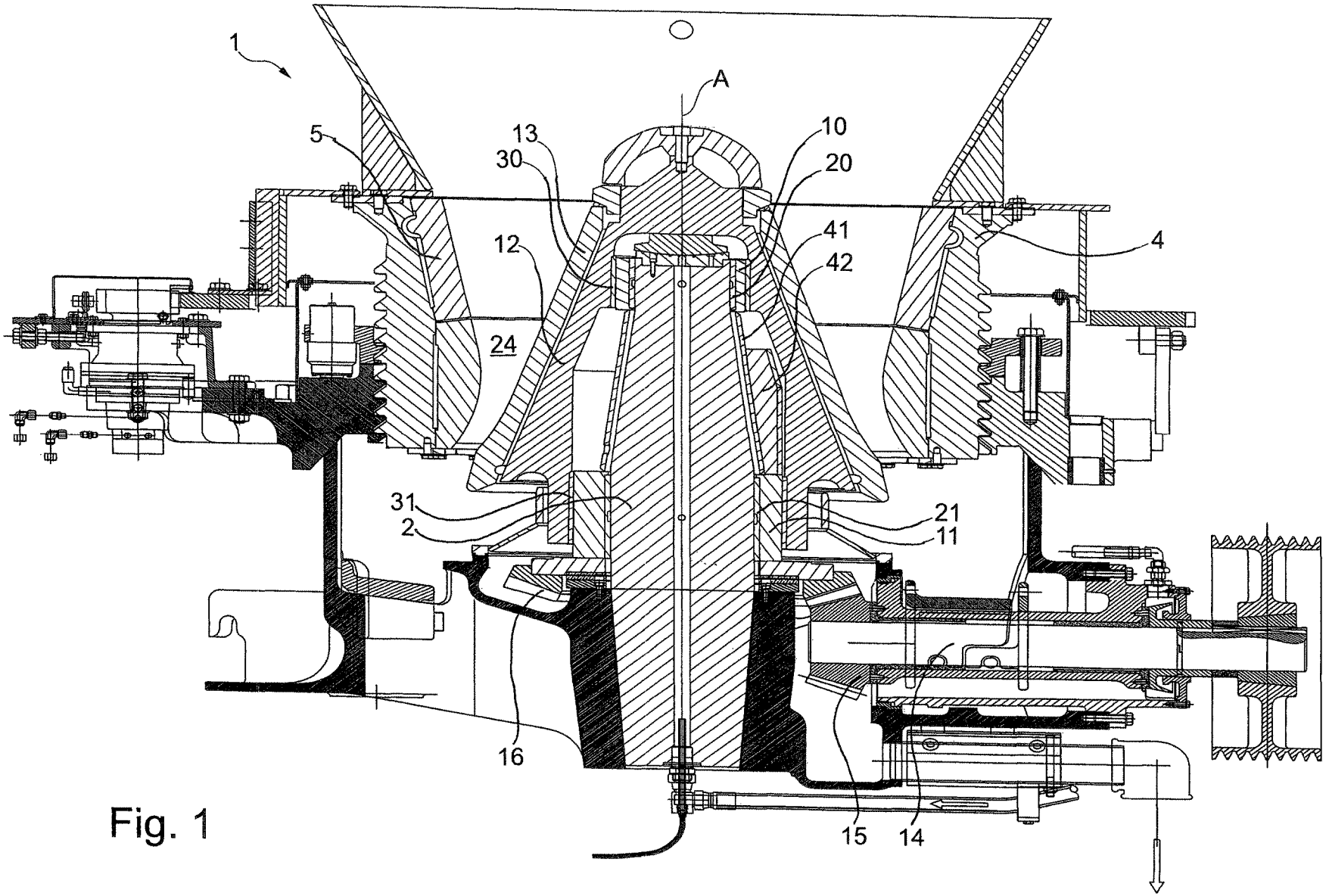
FIG. 1 shows schematically a gyratory crusher according to a first embodiment.

FIG. 1 schematically illustrates a gyratory crusher 1 in section. The gyratory crusher 1 has a vertically extending main shaft 2 and a frame 4. The shaft 2 has a longitudinal axis coinciding with a central axis A of the crusher.

An eccentric assembly is provided, which includes a first and a second eccentric part which in the present embodiment are constituted by a first, upper and a second, lower eccentric ring 10, 11. The eccentric parts or rings 10, 11 are rotatably supported about the shaft 2 by means of two rotational shaft bearings, which in the present embodiment are configured by rotational slide bushings, 20 and 21. Each of the two eccentric rings 10, 11 is provided with a first or inner circumferential surface 10*a*, 11*a* (cf. FIG. 2) and a second or outer circumferential surface 10*b*, 11*b* (cf. FIG. 2) which is eccentrically arranged relative to the first circumferential surface 10*a*, 11*a*.

A crusher head 12 is radially supported by and rotatable about the eccentric rings 10, 11 via another pair of rotational bearings, in this case also rotational slide bushings, 30 and 31. Together, the shaft bearings 20, 21 and the head bearings 30, 31 form an eccentric bearing arrangement for guiding the crushing head 12 along a gyratory path.

A drive shaft 14 is connected to a drive motor and is provided with a pinion 15. The drive shaft 14 is arranged to rotate the lower eccentric ring 11 by the pinion 15 engaging a gear rim 16 mounted on the lower eccentric ring 11.

When the drive shaft 14 rotates the lower eccentric ring 11, during operation of the crusher 1, the crushing head 12 mounted thereon will execute a gyrating movement.

An inner crushing shell 13, also designated a mantle, is mounted on the crushing head 12. Crushing head 12 and mantle 13 are parts of an overall head assembly. An outer crushing shell 5, also designated a bowl, is mounted on the frame 4. A crushing gap 24 is formed between the two crushing shells 13, 5. When the crusher 1 is operated, material to be crushed is introduced in the crushing gap 24 and is crushed between the mantle 13 and the bowl 5 as a result of the gyrating movement of the crushing head 12, during which movement the mantle 13 approaches the outer one 5 along a rotating generatrix and moves away therefrom along a diametrically opposed generatrix.

Figure 2:
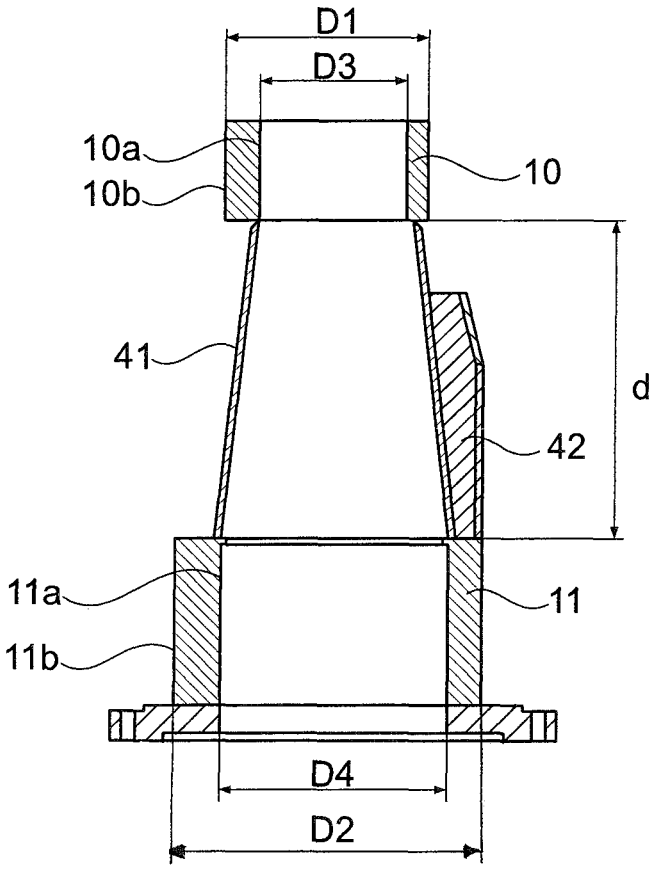
FIG. 2 is a partial enlargement of an eccentric assembly.

As shown in FIG. 2, the upper head bearing 30 has a diameter D1, which is defined as the diameter of the outer slide surface of the upper eccentric ring 10 at the upper head bearing 30. The lower head bearing 31 has a diameter D2, which is defined as the diameter of the outer slide surface of the lower eccentric ring 11 at the lower head bearing 31. In the disclosed embodiment the two outer diameters D1 and D2 are different, the diameter D1 being smaller than the diameter D2. In an alternative embodiment the two outer diameters D1 and D2 are equal. In yet another embodiment the diameter D1 is larger than the diameter D2.

The upper shaft bearing 20 has a diameter D3, which is defined as the diameter of the inner slide surface of the upper eccentric ring 10 at the upper shaft bearing 20. The lower shaft bearing 21 has a diameter D4, which is defined as the diameter of the inner slide surface of the lower eccentric ring 11 at the lower shaft bearing 21. In the disclosed embodiment the two inner diameters D3 and D2 are different, with the inner diameter D3 being smaller than the inner diameter D4. Of note, this also results in the main shaft 2 having a larger diameter in the area of the lower eccentric ring 20 and a smaller diameter in the area of the upper eccentric ring 10, with a cone-shaped section there between. In an alternative embodiment the two inner diameters D3 and D4 are equal. In yet another alternative embodiment the two inner diameters D3 and D4 are different, with the inner diameter D3 being larger than the inner diameter D4.

The upper and lower eccentric rings 10, 11 are vertically separated along the central axis A by a distance d. Between the upper and lower eccentric rings 10, 11, as seen in the vertical direction, an intermediate part is provided which in the present embodiment is configured by a non-eccentric carrier sleeve 41. At an upper end, the carrier sleeve 41 is coupled to the upper eccentric ring 10, and at a lower end thereof, the carrier sleeve 41 is coupled to the lower eccentric ring 11, so that the carrier sleeve 41 and eccentric rings 10, 11 rotate in unison about the main shaft 2.

Of note, the intermediate element or carrier sleeve 41 must not necessarily be non-eccentric, but any eccentricity thereof at least differs from the eccentricity of the first and second eccentric rings 10, 11.

The carrier sleeve 41 in turn is part of a counterweight assembly 40. The counterweight assembly 40 further includes a counterweight body 42 assembled to an outer circumferential surface of the carrier sleeve 41. The counterweight assembly 40 is designed to provide balance for the offset rotation of the eccentric rings 10, 11 about the stationary main shaft 2 and the gyratory motion of the crushing head 12 and mantle 13.

Referring now to FIG. 2, there shown is one embodiment of the counterweight assembly 40 of the present invention. As illustrated in FIG. 2, the counterweight assembly 40 is made up from a carrier sleeve 41 and the counterweight body 42 as such, which is a cast component in the present embodiment, but other methods of forming the counterweight body 42 are contemplated as being within the scope of the present disclosure. The carrier sleeve 41 is a thin walled structural part which is generally cone shaped in the present embodiment, the cone shape of the carrier sleeve 41 following the cone shape of the main shaft 2 or the conical section thereof, respectively. The counterweight body 42 is attached to the carrier sleeve 41 so as to form a weighted section of the counterweight assembly 40 which is generally opposite the wide portions of the eccentric rings 10, 11, whereas the unweighted section of the counterweight assembly 40—i.e. that part of the carrier sleeve 41 which does not carry the counterweight body 42—is generally opposite the thin portions of the eccentric rings 10, 11. The counterweight body 42 may be attached to the carrier sleeve 41 e.g. by welding, or by means of bolts, pins or rivets.

The counterweight body 42 could be made from any suitable material, e.g. steel, cast iron, lead, or depleted uranium. The counterweight body 42 could be made from the same material as the eccentric rings 10, 11, or—in particular if space is limited—from a material which has a higher density than the material used for the eccentric rings 10, 11.

To achieve optimum balance conditions, the mass and center of gravity of the eccentric assembly and head assembly taken together should be offset by the mass and center of gravity of the counterweight assembly 40. In order to determine a proper shape and location for the counterweight body 42, the mass and center of gravity of the moving parts within the crusher, i.e. the head assembly (including the crusher head 12, the mantle 13 mounted thereon, and the associated seals and bushings) and the eccentric assembly are therefore calculated first. The shape of the counterweight body 42 is then designed so that the counterweight assembly 40 compensates for the mass eccentricity of the eccentric assembly and the head assembly. The eccentric assembly, counterweight assembly and head assembly are thereby balanced to produce no net horizontal forces on the foundation. The forces and moments acting on the main shaft during crusher operation are balanced, thereby permitting smooth and relatively vibration free operation of the crusher.

In order to achieve this balancing of forces, the counterweight assembly 40 is configured and arranged so that with respect to the vertical position, the center of gravity of the counterweight assembly 40 is located as closely as possible to the center of gravity of the eccentric and head assemblies taken together, while the center of gravity of the counterweight assembly 40 is located diametrically opposite the center of gravity of the eccentric and head assemblies as seen in the radial direction. In order to locate the center of gravity of the counterweight body 42 accordingly, the carrier sleeve 41 and counterweight body 42 are specifically configured. In the present embodiment, the carrier sleeve 41 is generally cone shaped. The counterweight body 42 has lower section with a cylindrical outer surface and an upper section with a tapered outer surface, the taper substantially following a taper of the carrier sleeve. Of note, the shape of the counterweight body 42 can be arbitrarily chosen as long as the shape suitably provides the required center of gravity of the counterweight assembly, and as long as the counterweight fits in the available space.

Of note, the counterweight assembly 40 must not necessarily perfectly compensate for the forces created by the offset rotation of the eccentric rings 10, 11 about the stationary main shaft 2 and the gyratory motion of the crushing head 12. Furthermore, the mantle 13 is subject to wear, so that the center of gravity of the moving parts changes over time. In order to take this wear into account, the counterweight assembly 40 can e.g. be designed for the case that the mantle 13 is half worn, so as to maintain balance over a certain time frame.

Figure 3:
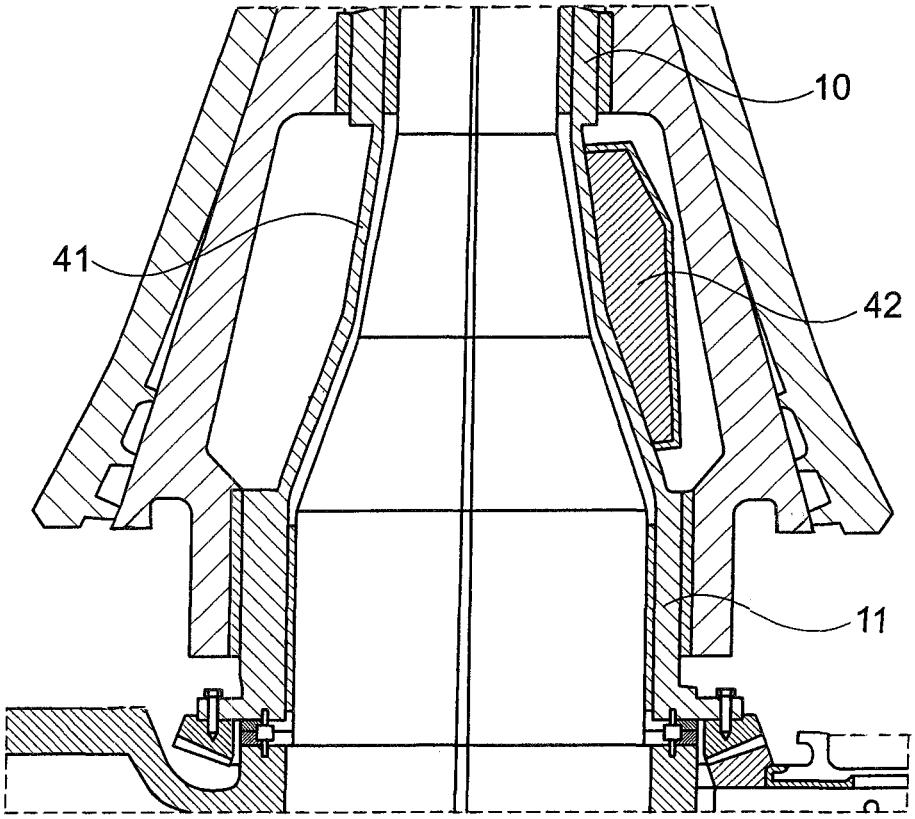
FIG. 3 shows schematically a gyratory crusher according to a second embodiment.

FIG. 3 illustrates an alternative embodiment which differs from the embodiment of FIGS. 1 and 2 in that the non-eccentric carrier sleeve 41 of the counterweight assembly 40 is formed integrally with the upper 10 and lower eccentric rings 11, rather than welded thereto.

The crusher of FIG. 3 further differs from the one of FIGS. 1 and 2 in that the carrier sleeve 41 has two sections having different inclinations relative to the central axis A, again following a corresponding shape of the main shaft 2. Also in the embodiment of FIG. 3, the counterweight body 42 has two sections, the outer circumferential surfaces of which have different inclinations relative to the central axis A.

While the embodiments described above relate to a stationary crusher, the solution according to the present invention is also applicable to mobile crushing plants. As explained above, the provision of the first and second eccentric parts according to the present invention allows for an improved balancing of the moving parts within the crusher, which in turn can reduce the resonance vibrations. This can be particularly advantageous for mobile equipment which has a less rigid support than a stationary crusher.

What is claimed is:

1. An eccentric assembly for use in a gyratory or cone crusher, the gyratory or cone crusher comprising:

a main shaft having a longitudinal extension along a central axis of the crusher, a head assembly including a crushing head provided with a first crushing shell, and a frame provided with a second crushing shell, wherein the first crushing shell and the second crushing shell between them define a crushing gap; and the eccentric assembly being provided with an inner circumferential surface and an outer circumferential surface eccentrically arranged relative to the inner circumferential surface, wherein the inner circumferential surface of the eccentric assembly is arranged for being journalled to the main shaft so that the eccentric assembly is adapted to rotate about said central axis, and wherein the outer circumferential surface of the eccentric assembly is arranged for being journalled to the crushing head, wherein the eccentric assembly includes a first eccentric part and a second eccentric part which is configured for being spaced apart by a distance from the first eccentric part in a direction along the central axis, the eccentric assembly further comprises a counterweight assembly including a counterweight body, the counterweight assembly being configured so as to rotate together with the eccentric assembly and being configured so as to compensate for unbalanced forces generated by a gyratory movement of the head assembly and an offset rotation of the eccentric assembly, wherein the counterweight body is located between the first eccentric part and the second eccentric part as seen in the direction along the central axis.

2. The eccentric assembly of claim 1, further comprising an intermediate element arranged between the first eccentric part and the second eccentric part in the direction along the central axis, the intermediate element having either a non-eccentric shape or an eccentricity which is different from the eccentricity of the first eccentric part and second eccentric part.

3. The eccentric assembly of claim 2, in which the intermediate element is coupled to the first eccentric part and/or the second eccentric part so as to rotate together therewith.

4. The eccentric assembly of claim 2, wherein the intermediate element is formed in one piece with the first eccentric part and/or the second eccentric part.

5. The eccentric assembly of claim 2, wherein the intermediate element is formed separate from and coupled with the first and/or the second eccentric part.

6. The eccentric assembly of claim 2, wherein the intermediate element is configured as a sleeve surrounding the main shaft.

7. The eccentric assembly of claim 1, wherein the counterweight assembly is coupled to the first eccentric part and the second eccentric part so as to rotate together therewith.

8. The eccentric assembly of claim 2, wherein the counterweight body is coupled to the intermediate element of the eccentric assembly.

9. The eccentric assembly of claim 8, wherein the counterweight body is formed in one piece with the intermediate element.

10. The eccentric assembly of claim 8, wherein the counterweight body is formed separate from and coupled with the intermediate element.

11. A gyratory or cone crusher comprising:

a main shaft having a longitudinal extension along a central axis of the crusher, a head assembly including a crushing head provided with a first crushing shell, a frame provided with a second crushing shell, wherein the first crushing shell and second crushing shell between them define a crushing gap, and an eccentric assembly provided with an inner circumferential surface and an outer circumferential surface eccentrically arranged relative to the inner circumferential surface, wherein the inner circumferential surface of the eccentric assembly is journalled to the main shaft so that the eccentric assembly is adapted to rotate about said central axis, and wherein the outer circumferential surface of the eccentric assembly is journalled to the crushing head, wherein the eccentric assembly includes a first eccentric part and a second eccentric part which is spaced apart by a distance from the first eccentric part in a direction along the central axis, the crusher further comprises a counterweight assembly including a counterweight body, the counterweight assembly being configured so as to rotate together with the eccentric assembly and being configured so as to compensate for unbalanced forces generated by a gyratory movement of the head assembly and an offset rotation of the eccentric assembly, wherein the counterweight body is located between the first eccentric part and the second eccentric part seen in the direction along the central axis.

12. The gyratory or cone crusher of claim 11, wherein the counterweight assembly is configured and arranged so that the center of gravity thereof is arranged essentially at the same vertical height as the center of gravity of the combination of the eccentric assembly and head assembly, and diametrically opposite thereto.

13. The gyratory or cone crusher of claim 11 wherein the counterweight assembly includes the counterweight body coupled to the first eccentric part and the second eccentric part of the eccentric assembly, the counterweight assembly being configured so as to rotate together with the eccentric assembly of the gyratory or cone crusher and compensate for unbalanced forces generated by the gyratory movement of the head assembly and the offset rotation of the eccentric assembly of the gyratory or cone crusher.

* * * * *